United States Patent [19]

Emery et al.

[11] Patent Number: 4,622,875

[45] Date of Patent: Nov. 18, 1986

[54] SYSTEM AND PROCESS FOR SORTING AND OPENING PACKAGES

[75] Inventors: Clayton N. Emery, Middletown; Howard M. Harper, Louisville, both of Ky.

[73] Assignee: Brown & Williamson Tobacco Corporation, Louisville, Ky.

[21] Appl. No.: 593,004

[22] Filed: Mar. 23, 1984

[51] Int. Cl.[4] ..... B26D 7/06; B26F 3/00; B07C 5/34

[52] U.S. Cl. ..... 83/80; 83/177; 83/522; 131/96; 209/535; 209/552; 209/583

[58] Field of Search ..... 209/535, 536, 563–566, 209/569, 583, 930, 552, 557, 644, 932; 194/4 C; 131/96; 83/53, 177, 80, 522; 235/462, 470, 471; 241/81

[56] References Cited

U.S. PATENT DOCUMENTS

| | | | |
|---|---|---|---|
| 3,086,121 | 4/1963 | Cockrell | 209/583 X |
| 3,595,389 | 7/1971 | Morgan et al. | 209/930 X |
| 3,639,728 | 2/1972 | Helfand et al. | 209/583 X |
| 3,645,391 | 2/1972 | Hirawaka et al. | 209/583 X |
| 3,721,340 | 3/1973 | Kruse et al. | 209/536 |
| 3,743,090 | 7/1973 | Brown et al. | 209/583 X |
| 4,044,227 | 8/1977 | Holm et al. | 209/583 X |
| 4,248,389 | 2/1981 | Thompson et al. | 209/564 X |
| 4,386,708 | 6/1983 | Sieverin | 209/644 X |

FOREIGN PATENT DOCUMENTS

| | | | |
|---|---|---|---|
| 1004768 | 2/1977 | Canada | 235/471 |
| 0620058 | 10/1935 | Fed. Rep. of Germany | 131/96 |
| 54-13169 | 1/1979 | Japan | 209/565 |

*Primary Examiner*—Robert B. Reeves
*Assistant Examiner*—Edward M. Wacyra
*Attorney, Agent, or Firm*—Charles G. Lamb

[57] ABSTRACT

A system and process for sorting and opening packages particularly suitable for reclaiming reusable, returned goods. The system and process separates unusable returned goods from reusable returned goods, and gathers information and data on the goods which information can be of benefit to management. The system and process provides for optically reading the Universal Product Codes on the packages of reusable and unusable goods. Based on this UPC code identification, the packages are segregated into categories of reusable and unusable goods. The system and process further segregates the reusable goods into various different types of reusable goods based on predetermined criteria. The system and process even further provides for automatically opening the packages containing reusable goods, and separating the goods from the opened packages.

13 Claims, 2 Drawing Figures

SYSTEM AND PROCESS FOR SORTING AND OPENING PACKAGES

BACKGROUND OF THE INVENTION

1. Field of the Invention

The present invention relates to systems and processes for reclaiming goods, and more particularly to a system and process for automatically separating reusable goods from unusuable goods, gathering data on the goods, automatically opening the packaging containing the resuable goods and removing the reusuable goods from their opened packagings. The present invention further provides for automatically segregating various types of reusable goods prior to the removal of the reusuable goods from their opened containers.

2. Description of the Prior Art

Various systems and processes are known for reclaiming returned goods. These systems and processes will vary from industry to industry and are dictated, to a certain extent, by the nature of the goods.

In the tabacco industry, for example, in reclaiming reusable tobacco from returned cigarettes it is important to separate competitors' brands from one's own brands because of quality and composition differences. In addition, for the reason that taxes are prepaid, a tax credit can be obtained on tobacco products that have been returned unsold.

While equipment for opening packages containing returned tobacco goods and separating the tobacco goods from the opened packages are known, the preliminary work such as sorting competitors' brands from one's own brands, and the required documentation accounting for the quantity of tobacco goods returned were done manually.

Examples of equipment for opening cigarette packages and removing cigarettes from the opened packages are shown in U.S. Pat. No. 3,386,320 issued on June 4, 1968 to J. R. Pinkham and U.S. Pat. No. 4,083,499 issued on Apr. 11, 1978 to R. E. Thatcher.

U.S. Pat. No. 3,386,320 teaches an apparatus for opening cigarette packages. The packages to be opened are transported on a conveyor belt between two cutting wheels. The packages are arranged longitudinally on the belt in single file. The cutting wheels revolve in a horizontal plane and are spaced apart by a distance somewhat less than the width of a package so that each cutting wheel makes a slit in an opposite side of the package. The slit packages then move to a second conveyor belt located perpendicularly to the first conveyor belt. When the slit packages are transferred to the second conveyor belt they are arranged transversely on the belt in single file. A cutting wheel which revolves in a vertical plane is located over the second conveyor belt so that the packages moving on the second belt are severed. The severed sections are conveyed to tumbler drums to separate the wrappers from the tobacco.

U.S. Pat. No. 4,083,499 teaches an apparatus for opening cigarette packages which includes a closed air duct conveyor having a centrifugal fan at one end and a cyclone hopper at the other. A high velocity air stream passes through the conveyor duct in a direction from the centrifugal fan toward the hopper. Cigarette packages to be opened are conveyed on an enclosed conveyor belt into the centrifugal fan which breaks open the packages. The smaller pieces of the broken packages move with the air stream in the conveyor duct to the cyclone hopper. The heavier pieces of packages fall back into the fan for continued impact by the fan until they are sufficiently broken to be carried by the air stream in the conveyor duct to the cyclone hopper.

SUMMARY OF THE INVENTION

It is an object of the present invention to provide a system and process for automatically sorting reusable returned goods from unusable returned goods, opening the packages containing the reusable returned goods, and separating the reusable goods from the opened packages.

It is another object of the present invention to further automatically segregate various types of reusable goods from each other before the packages containing the goods are opened.

It is yet another object of the present invention to automaticaly gather information and data on the reusable returned goods as they are being sorted from the unusable returned goods.

It is still another object of the present invention to utilize the Uniform Product Code on the packages containing the returned goods to sort reusable goods from unusable goods, and also to segregate the various types of reusable goods from each other.

More particularly, the present invention provides a system for reclaiming reusable, returned goods comprising means for conveying packages of goods to be sorted; Universal Product Code reading means located at a preselected location at the conveyor means for reading the Universal Product Code on each of the packages being conveyed on the conveyor means, processor means operatively associated with the Universal Product Code reading means for receiving the signal representing the Universal Product Code from the reading means and comparing the Universal Product Code with stored information related to the Universal Product Code, and ejector means operatively associated with the processor means for ejecting packages not identified by the processor means from the conveyor means.

BRIEF DESCRIPTION OF THE DRAWINGS

The objects and advantages of the present invention will become evident upon reference to the following discussion in conjunction with the drawings wherein.

DETAILED DESCRIPTION OF THE PREFERRED EMBODIMENT

Figure 1:
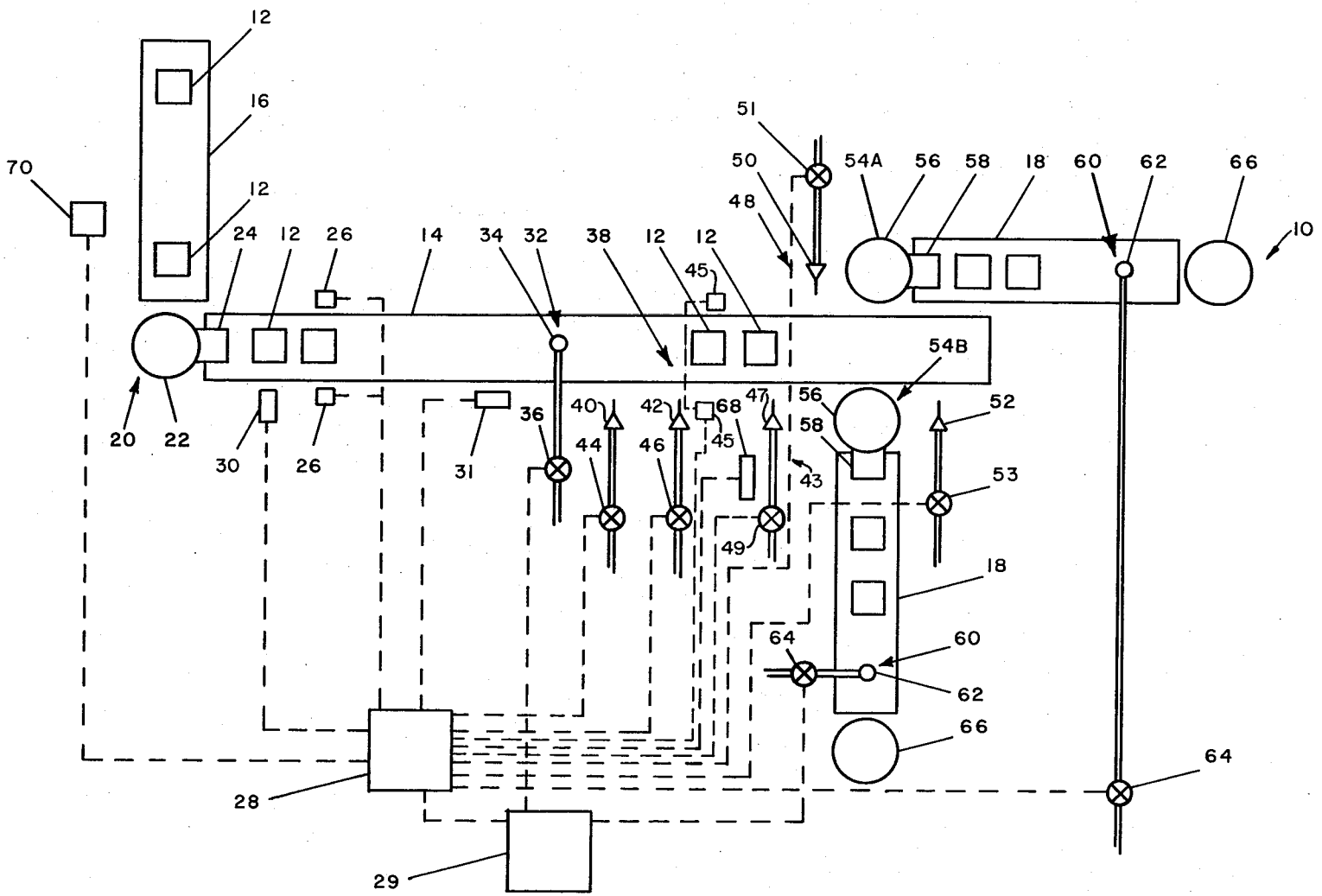
FIG. 1 is a schematic plan view of a system for reclaiming returned goods embodying the features of the present invention; and, FIG. 2 is a schematic flow chart depicting the data processing structure of the present invention.

With reference to FIG. 1, there is illustrated a system, generally denoted as the numeral 10, for sorting and opening packages 12 which is particularly useful for reclaiming returned goods contained in the packages 12. The system 10 is shown as including at least one sorting conveyor 14, a preliminary search conveyor 16 at the upstream end of the sorting conveyor 14 and a plurality of sorted package conveyors 18 at the downstream end of the sorting conveyor 14. The number of sorted package conveyors 18 is equal to the number of different kinds of goods to be sorted, each sorted package conveyor 18 being adapted to receive and transport the sorted packages containing a different one of the kinds of goods. For the sake of brevity, the illustrated embodiment of the system 10 is used to sort packages 12 of two different kinds of goods and, therefore, the system 10 includes two sorted package conveyors 18. The sorting conveyor 14, preliminary search conveyor 16, and sorted package conveyors 18 can be virtually of any type, for example, endless belt conveyors, or the like.

A first package alignment means 20 is located between the preliminary search conveyor 16 and the sorting conveyor 14 at the upstream end of the sorting conveyor 14. The function of the first package alignment means 20 is to arrange packages 12 to be sorted, received from the preliminary search conveyor 16, in spaced apart, end-to-end relationship on the sorting conveyor 14. The first package alignment means 20 can include, for example, a hopper 22 into which the packages 12 are received from the preliminary search conveyor 16 and package chutes 24 in communication with the open bottom of the hopper configured to dispense packages 12 from the hopper 22 onto the sorting conveyor 14 in a predetermined orientation.

A pair of laser scanners 26 are located on opposite longitudinal sides of the sorting conveyor 14 downstream from the first package alignment means 20 for reading the Universal Product Code (hereinafter referred to as UPC) on the packages 12 as they move on the sorting conveyor 14 past the scanners 26. Toward this objective, the first package alignment means 20 orients the packages 12 on the sorting conveyor 14 with the UPC facing toward one or the other of the longitudinal sides of the sorting conveyor 14.

The laser scanners 26 are operatively associated with data file and processing means 28 such as, for example, a computer or microprocessor, which contains information characterizing the packages to be sorted based upon the UPC. The data file means is also used to gather information on the packages being sorted such as, for example, the number of such packages.

First package detection means such as at least one first photocell 30 is located at the sorting conveyor 14 upstream of the laser scanners 26. The photocell 30 is operatively associated with the data file means 28 to signal the data file means of the passing of a package 12 and is used to synchronize the positioning of a package at the scanners 26 with the UPC reading event performed by the scanners 26. Further, the speed of the sorting conveyor 14 is monitored by the data file means computer 28 as a further aid in monitoring the position of the packages 12 as they move on the sorting conveyor 14. Toward this end, the sorting conveyor 14 can be equipped with, for example, a pulse generator 31 operatively associated with the data file means computer. Thus, the position of each package 12 is tracked as it progresses along the sorting conveyor 14.

Package slitting means 32 is located over the sorting conveyor 14 downstream from the first photocell 30. The package slitting means 32 makes a slit in each of the packages 12 as they move on the sorting conveyor 14 past the slitting means 32.

Preferably, the package slitting means 32 utilizes a high velocity water jet to slit the packages 12. Toward this end, the package slitting means 32 includes a water nozzle 34 for directing a water jet downwardly against the top surface of the packages 12 moving on the sorting conveyor 14. The activation of the water jet nozzle 34 is controlled by a program logic controller (hereinafter referred to a PLC) 29 so that the jet nozzle 34 is activated only when a package 12 is in a proper position beneath the nozzle 34. This can be accomplished by, for example, utilizing a solenoid valve 36 in the water supply line to the nozzle 34 which is operatively associated with the computer 28.

After the packages 12 are slit, they continue to move with the sorting conveyor 14 into a first ejection means 38 whereat packages 12 either unidentified by the scanners 26, or identified as containing unreusuable goods, such as for example, competitors' goods, are ejected from the sorting conveyor 14.

The first package ejection means 38 utilizes two high velocity air jets to eject packages from the sorting conveyor 14, one jet for ejecting unidentified packages and the other jet for ejecting unreusuable packages of goods from the sorting conveyor 14. This can be accomplished by using, for example, two air jet nozzles 40 and 42 located on longitudinal sides of the sorting conveyor 14 and pointing across the sorting conveyor 14.

The apparatus 10 further includes second ejection means 43 for ejecting the packages 12 previously selected for ejection from the sorting conveyor 14 by the first ejection means 38, but which packages 12 were in fact, for one reason or another, not ejected by the first ejector means 12. Toward this objective, the second ejector means 43 includes second package detecting means such as at least one second photocell 45 located at the sorting conveyor 14 downstream of the first ejector means 38. The second photocell 45 is operatively associated with the data file means 28 to signal the data file means of the passing of such a package 12. In addition, the second ejector means 43 utilizes a high velocity air jet to eject packages from the sorting conveyor 14 using, for example, an air jet nozzle 47 located on one longitudinal side of the sorting conveyor.

In operation of the first package ejector means 38, one air jet nozzle 40 is used to direct a jet of air against unidentified packages 12 ejecting them to one side of the sorting conveyor 14, and the other air jet nozzle 42 is used to direct a jet of air against packages identified as containing unreusable goods ejecting them to one side of the sorting conveyor 14. The activation of the air jet nozzles 40 and 42 are also controlled by the computer 28 through the PLC. This can be accomplished by, for example, using solenoid valves 44 and 46 in the air supply lines to the air jet nozzles 40 and 42, respectively, which are operatively associated with the computer 28. The packages 12 remaining on the sorting conveyor 14 contain reusable goods.

In operation of the second package ejector means 43, the air jet nozzle 47 is used to direct a jet of air against a package 12 which had previously been selected for ejection by the scanner 26, but was in fact not ejected by the first ejector means 38, thus, ejecting the package 12 to one side of the conveyor 14. The activation of the air jet nozzle 47 is controlled by the data file means 28 by, for example, using a solenoid valve 49 in the air supply line to the air jet nozzle 47.

The packages 12 remaining on the sorting conveyor 14 continue to move with the sorting conveyor 14 to a sorting means 48 whereat packages 12 containing different kinds of goods are sorted from each other and diverted to different ones of the sorted package conveyors 18 for further processing.

For the reason, previously mentioned, that in the illustrated system 10 packages of two different kinds of goods are to be sorted from each other, the sorting means 48 utilizes two high velocity air jets to selectively divert the packages 12 to one or the other of the two sorted package conveyors 18. One air jet diverts packages identified as containing one kind of goods to one of the sorted package conveyors 18, and the other air jet diverts packages identified as containing the other kind of goods to the other one of the sorted package conveyors 18. This can be accomplished by usng, for example, two air jet nozzles 50 and 52 located at the downstream end of the sorting conveyor 14 and pointing in appropriate directions to direct selected packages 12 toward one or the other of the sorted package conveyors 18. As shown, air jet nozzle 50 is used to direct a jet of air against packages 12 containing one kind of goods in a direction toward one of the sorted package conveyors 18, and the other air jet nozzle 52 is used to direct a jet of air against packages 12 containing another kind of goods in a direction toward the other one of the sorted package conveyors 18. The activation of the air jet nozzles 50 and 52 are controlled by the computer 28. This can be accomplished by, for example, using solenoid valves 51 and 53 in the air supply lines to the air jet nozzles 50 and 52, respectively, which are operatively associated with the computer 28.

A second package alignment means 54A is located between the sorting conveyor 14 and one of the sorted package conveyors 18, and a third package alignment means 54B is located between the sorting conveyor 14 and the other one of the sorted package conveyors 18.

As shown, the second and third package alignment means 54A and 54B are essentially identical. Each of the second and third package alignment means 54A and 54B receives selected sorted packages from the sorting conveyor 14 and orients the packages on their respective associated sorted package conveyor 18 in spaced apart side-to-side relationship, but turned 90° to the orientation of the packages 12 on the sorting conveyor 14. Each of the second and third package alignment means 54A and 54B can include, for example, a hopper 56 into which selected sorted packages are received from the sorting conveyor 14 and a package chute 58 in communication with the open bottom of the hopper 56 configured to dispense packages from the hopper 56 onto the sorted package conveyor 18 in a predetermined orientation.

Package severing means 60 is located over each of the sorted package conveyors 18. The package severing means 60 severs the packages moving on the sorted package conveyors 18 across the slit previously made in the packages by the slitting means 32 as the packages pass by. Preferably, the package severing means 60 located at each sorted package conveyor 18 utilizes a high velocity water jet to cut through the packages 12. Toward this end, each package severing means 60 includes a water nozzle 62 for directing a water jet downwardly against the packages 12 moving on the sorted package conveyor 18 beneath the nozzle 62. The activation of the water jet nozzle 62 is controlled by the PLC 29 so that the jet nozzle 62 is continuously activated while packages 12 are being conveyed in the proper orientation beneath the nozzle 62. This can be accomplished by, for example, utilizing a solenoid valve 64 in the water supply line to the jet nozzle 62 which is operatively associated with the PLC.

At the downstream end of each sorted package conveyor 18, there is located a separation device 66 for separating the package material from the contents. The separation devices 66 are shown as tumbler barrels. The severed packages 12 are deposited into the tumbler barrels 66 from their associated sorted package conveyors 18. The tumbling motion of the barrels 66 separates the contents from the severed, open package material. The package material is removed from the separtion tumbler barrels for disposal, and the contents are removed from the separation tumbler barrels for further processing to make the contents suitable for reuse.

It is contemplated that at least some of the packages 12 ejected by the first ejection means 38 as being unidentified packages may in fact be suitable for reuse, and that the reason they were unidentified by the scanners 26 was that the Universal Product Code was obscured. Therefore, the unidentified packages are manually inspected to determine if any of these packages contain reusable product. The manual inspection station includes data input means 68 operatively associated with the data file means 28 to provide for the entry of data from the manually determined reusable packages into the data file means 28. The data input means 68 can be, for example, a hand held laser scanner or computer micro terminal. If a hand held scanner is used, it is manually passed over the UPC on the package. If a micro terminal is used, the digits composing the UPC number associated with the machine-readable UPC bar code is manually entered. Those manually inspected packages determined to contain reusable contents are reintroduced into the system 10 at the appropriate one of the second or third package alignment means 54A, 54B for further processing.

It is further contemplated that at least some packages received for sorting through the system 10 could be of a type not intended to be processed through the system 10 or be damaged packages. In either case, unsuitable packages could damage the system 10 if they would be processed. Therefore, the packages are initially manually inspected on the preliminary search conveyor 16 and unsuitable packages are manually removed before they reach the first package alignment means 20 at the upstream end of the sorting conveyor. Some of the unsuitable package, however, may contain reusable goods, and these packages are manually sorted and the contents removed separate from the system 10. The data from the packages manually determined to contain reusable goods is entered into the data file means 28 by data input means 70 such as, for example, a hand held scanner or computer micro terminal.

Figure 2:
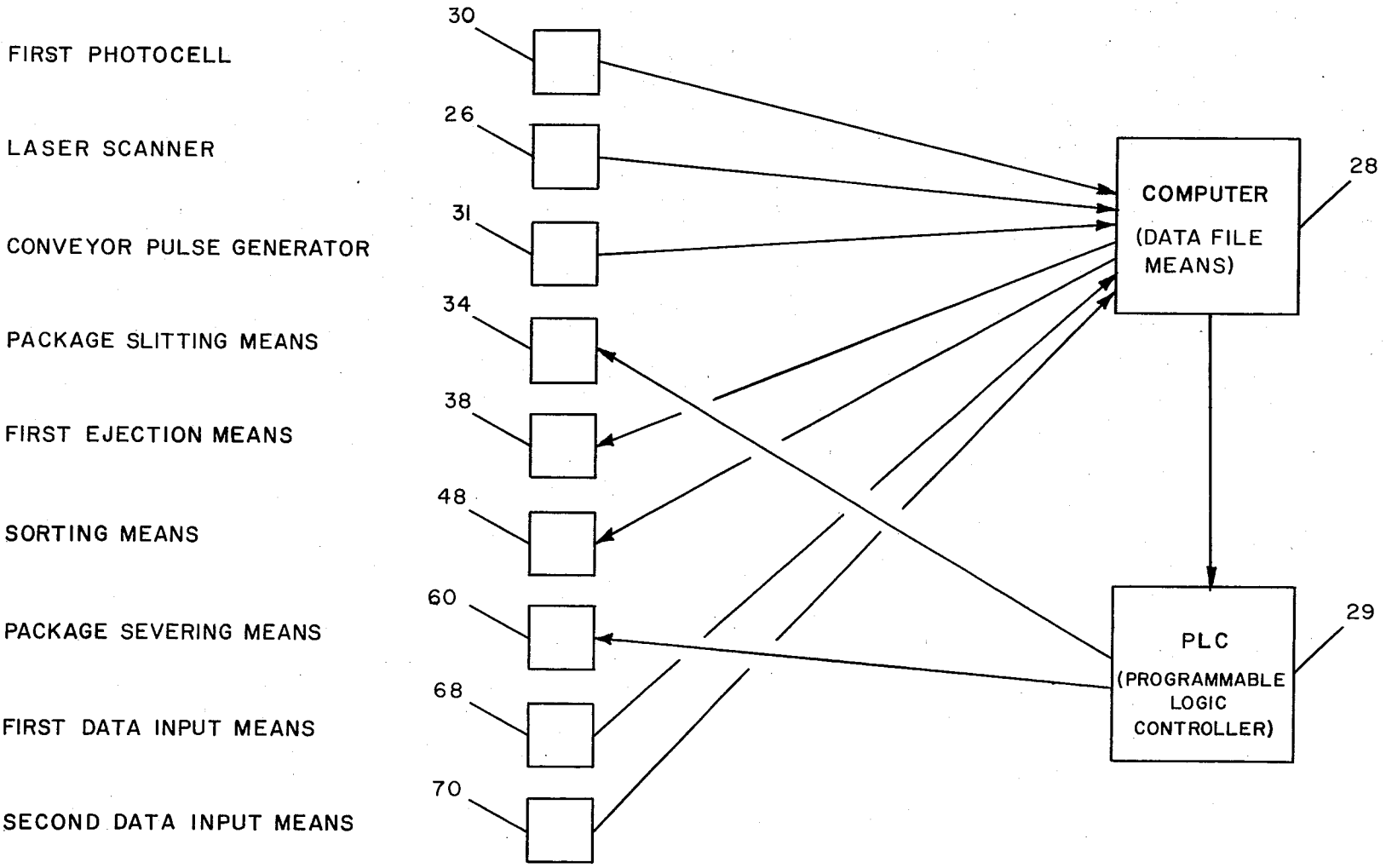

Now with reference to the schematic diagram of FIG. 2, there is shown the data processing and operational diagram for the system 10. Information characterizing the packages to be sorted, based upon the Universal Product Code is entered into the data file means 28. Additional information useful to management and which can be cross referenced to the UPC can also be entered into the data processing means 28. As the packages 12 to be sorted move past the laser scanner 26, the scanners 26 read the UPC and transmit the information to the data processing means 28. The incoming information from the scanners 26 is verified at the data processing means 28 against the UPC information stored therein. The data processing means 28 continuously updates the position of each package 12 as they travel along the sorting conveyor 14 based upon information received from the photocell 30 and conveyor pulse generator 31. As the PLC 29 determines that a package 12 is being conveyed on conveyor 14, the slitting means 32 is continuously activated to make a slit in each package 12 as it passes thereby. Based upon the information received from the photocell 30 and conveyor pulse generator 31, the data file means 28 and PLC determines when a package 12 has moved into position at the first ejection means 38. Based upon the information received from the laser scanners 26, the data processing means 28 determines whether the package 12 at the first ejection means 38 is unidentified or identified as containing unreusable contents. If the data file means 28 determines the package 12 to be unidentified, it activates the first ejection means 38 to open the solenoid valve 44 to allow a jet of air to issue through air jet nozzle 40. If the data file and processing means 28 determines the package 12 to contain unreusable contents, it activates the first ejection means 38 to open the solenoid valve 46 to allow a jet of air to issue through air jet nozzle 42. As the packages remaining on the sorting conveyor 14, the data processing means 28 determines when a package 12 is properly located at the sorting means 48 based upon the information received from the photocell 30 and conveyor pulse generator 31. Based upon information recieved from the laser scanners 26, the data processing means 28 determines what kind of goods are contained in the package. If the package 12 contains one kind of predetermined goods, the data processing means 28 and PLC activates the sorting means 48 to open the solenoid valve 51 to allow a jet of air to issue through air jet nozzle 50 pushing the package 12 into, for example, the second package alignment means 54A. If the package 12 contains the other kind of predetermined goods, the data processing means 28 activates the sorting means 48 to open the solenoid valve 53 to allow a jet of air to issue through air jet nozzle 52 pushing the package 12 into, for example, the third package alignment means 54B. The sorted packages move along their respective sorted package conveyors 18 until they reach the package severing means 60. Again, the PLC 29 determines that sorted packages are being conveyed past the severing means 60 and activates the severing means 60 by opening the solenoid valve 64 allowing a high velocity water jet to issue through the water nozzle 62. The first and second data input means 68 and 70 at the manual inspection station and at the preliminary search conveyor 16 send information based upon the Universal Product Code to the data processing means 28 so that this information can be accumulated with the information based upon the Universal Product Code supplied to the data processing means 28 by the laser scanners 26. Thus, a record is kept of all packages containing reusable goods processed through the system 10 which can be used for various purposes such as sales records and tax records.

The process and system of the present invention has been found to be particularly useful in the tobacco industry when unsold tobacco products are returned. It is standard procedure for the manufacturer of tobacco products to pay taxes on the tobacco product at the time of manufacture and the tobacco product manufacturer is also eligible for a tax rebate on unsold, returned tobacco products. The process and system of the present invention provides for a rapid and accurate count to be made of unsold, returned tobacco products in order to justify a tax rebate. In addition, if sometimes occurs that competitors' products are included in shipments of unsold, returned tobacco products. The process and system of the present invention provides for the rapid separation of competitors' products from the manufacturers unsold, returned products. Furthermore, much of the unsold, returned tobacco products can be salvaged and reprocessed for reuse. The process and system of the present invention also provides for the rapid sorting and opening of packages containing reusable products and the separation of the proudct from the package. The process and system of the present invention can also be used to gather information useful to management such as, for example, the geographical area that is the source of the unsold, returned goods.

It should be understood that various items of peripheral equipment can easily be included in the system and process of the present invention such as CRT monitor and printers.

The foregoing detailed description is given primarily for clearness of understanding and no unnecessary limitations should be understood therefrom for modifications will become obvious to those skilled in the art upon reading this disclosure and may be made without departing from the spirit of the invention or scope of the appended claims.

What is claimed is:

1. A system for sorting packages, comprising: means for conveying the packages to be sorted;

Universal Product Code reading means located at a preselected location at the conveyor means for reading the Universal Product Code on each of the packages being conveyed on the conveyor means;

processor means operatively associated with the Universal Product Code reading means for receiving the signal representing the Universal Product Code from the reading means and comparing the Universal Product Code with stored information related to the Universal Product Code;

first ejector means operatively associated with the processor means for ejecting packages not identified by the processor means from the conveyor means; and, detection means located at the conveyor means downstream of the first ejector means for determining if a package selected for ejection by the first ejector means was in fact ejected from the conveyor means.

2. The system of claim 1, further comprising sorting means located at a preselected location at the conveyor means downstream of the first ejector means for sorting packages remaining on the conveyor means into different categories.

3. The system of claim 2, wherein the sorting means is operatively associated with the processor means for sorting the packages into different categories based on the Universal Product Code.

4. The system of claim 2, further comprising second conveyor means downstream of the sorting means for separately conveying each of the different categories of sorted packages.

5. The system of claim 2, further comprising means for severing each of the sorted packages downstream of the sorting means.

6. The system of claim 5, wherein the package severing means comprises means for directing a jet of liquid against the packages to be severed.

7. The system of claim 2, further comprising package aligning means for aligning the packages on the conveying means upstream of the Universal Product Code reading means in a first orientation so that the Universal Product Code is exposed to the Universal Product Code reading means.

8. The system of claim 7, further comprising second package aligning means for aligning the packages sorted into different categories in a second orientation in preparation for being severed.

9. The system of claim 1, further comprising second ejector means operatively associated with the detector means for ejecting the packages previously selected for ejection by the first ejector means but which were not ejected.

10. The system of claim 1, wherein the detection means comprises photocell means for determining if a package selected for ejection by the first ejector means was ejected.

11. The system of claim 10, further comprising means for activating the photocell means in timed relationship to the movement of the packages on the conveyor means.

12. The system of claim 1, further comprising means for slitting open each of the packages on the conveyor means.

13. The system of claim 12, wherein the package slitting means comprises means for directing a jet of liquid against each of the packages to slit them open.

* * * * *